US005947116A

United States Patent [19]

Gamow et al.

[11] Patent Number: 5,947,116

[45] Date of Patent: Sep. 7, 1999

[54] UNDERWATER BREATHING APPARATUS WITH PRESSURIZED SNORKEL

[76] Inventors: R. Igor Gamow, 186 Canon Park; Dana L. Ruehlman, 5781 Rustic Knolls Dr., both of Boulder, Colo. 80302

[21] Appl. No.: 08/672,447

[22] Filed: Jun. 28, 1996

Related U.S. Application Data

[63] Continuation-in-part of application No. 08/313,877, Sep. 28, 1994, abandoned.

[51] Int. Cl.[6] ..... B63C 11/16

[52] U.S. Cl. ..... 128/201.11; 128/201.27; 128/201.28; 128/204.26; 128/205.24

[58] Field of Search ..... 128/200.24, 201.11, 128/200.29, 204.18, 204.26, 204.29, 205.18, 205.22, 205.24, 205.25, 206.21, 206.28, 207.12

[56] References Cited

U.S. PATENT DOCUMENTS

| | | | |
|---|---|---|---|
| 2,743,722 | 5/1956 | McLean | 128/204.26 |
| 2,766,752 | 10/1956 | Meidenbaur, Jr. | 128/204.26 |
| 3,570,808 | 3/1971 | Wren | 251/207.26 X |
| 4,022,201 | 5/1977 | Diggs | 128/201.11 |
| 4,245,632 | 1/1981 | Houston | 128/205.13 |
| 4,583,536 | 4/1986 | Jan | 128/201.11 |
| 4,674,493 | 6/1987 | Mitchell | 128/202.14 |
| 4,832,013 | 5/1989 | Hartdorn | 128/202.14 |
| 5,193,530 | 3/1993 | Gamow et al. | 128/201.27 |
| 5,377,670 | 1/1995 | Smith | 128/204.17 |
| 5,471,976 | 12/1995 | Smith | 128/201.27 |
| 5,606,967 | 3/1997 | Wang | 128/201.11 |
| 5,622,165 | 4/1997 | Huang | 128/201.11 |
| 5,623,922 | 4/1997 | Smith | 128/204.18 |
| 5,735,266 | 4/1998 | Smith | 128/204.18 |

FOREIGN PATENT DOCUMENTS

| | | | |
|---|---|---|---|
| 63-195091 | 8/1988 | Japan | 128/201.11 |
| 590096 | 7/1947 | United Kingdom | 128/204.26 |
| 912579 | 12/1962 | United Kingdom | 128/204.26 |
| 94/29167 | 12/1994 | WIPO | 128/201.11 |

*Primary Examiner*—John G. Weiss
*Assistant Examiner*—Joseph F. Weiss, Jr.
*Attorney, Agent, or Firm*—Douglass F. Vincent

[57] ABSTRACT

An underwater breathing apparatus is provided for delivering air to a diver submerged to a depth between one and 12 feet. A pump delivers air at low pressure via an expandable air hose to a regulator worn by the diver. The air hose provides a reservoir of air for the supply the diver. Upon inhalation by the diver, the air pressure within the diver's lungs is reduced, thereby causing a tilt valve located within the regulator opens to allow air from the air hose to be supplied to the diver until the air pressure within the diver's lungs is equal to the air pressure generated by the pump in the air hose, which in turn causes the tilt valve to close. An exhalation one-way valve is also provided in the regulator to allow the diver to exhale without forcing the exhaled air back into the air hose.

15 Claims, 4 Drawing Sheets

UNDERWATER BREATHING APPARATUS WITH PRESSURIZED SNORKEL

CROSS REFERENCE TO RELATED APPLICATION

This patent application is a continuation-in-part application of application Ser. No. 08/313,877, filed Sep. 28, 1994, and entitled Pressurized Snorkel now abandoned.

BACKGROUND OF THE INVENTION

1. Field of the Invention

This invention relates generally to an underwater breathing device and, more particularly, to an underwater breathing device utilizing a pump to supply low pressure air to a regulator that is worn by a diver and that includes a diaphragm activated tilt valve.

2. Description of the Prior Art

Devices for facilitating underwater breathing by divers are known in the art. One of the most familiar is the system commonly known as scuba, which comprises a high pressure air tank worn by a diver who is supplied air via a flexible air hose connected to the air tank. The air pressure in the air tank is typically in a range between 2,000 to 3,000 pounds-per-square-inch (PSI) and usually needs to be greater than 200 PSI in order for the scuba system to work effectively. The high pressure of the air must be reduced before the air is supplied to the diver and is conventional done through the use of a first stage regulator located on the air tank and a second stage regulator located at the mouth piece or mask worn by the diver. The first stage is located between the air tank and the air line and reduces the air pressure of the air in the air tank from the 2,000 to 3,000 PSI range to approximately a 60 to 150 PSI range before the air enters the air line. The second stage regulator is located at the opposite end of the air line from the first stage regulator and reduces the air pressure of the air in the air line from the 50 to 150 PSI range to a PSI level breathable by the diver before the air enters the regulator worn by the diver and is supplied to the diver for breathing. The air pressure of the air supplied to the diver for breathing will vary depending on the depth of the diver. For example, at a depth of ten feet, the air will be supplied to the diver by the second stage regulator at five PSI, while at a depth of twenty feet, the air will be supplied to the diver by the second stage regulator at ten PSI. In a conventional scuba system, therefore, the air pressure of the air in the air line is at a high pressure which compacts the air molecules in the air line, thereby causing the air supplied to the second stage regulator to be supplied at a low volume. As the second stage regulator reduces the air pressure of the air flowing from the air line and to the diver, the molecules of air will expand to a point determined by the depth of the diver. Scuba systems can allow trained divers to easily obtain depths of two hundred feet or more. A basic scuba apparatus is described in U.S. Pat. No. 829,274 issued to Knoff.

Despite the advantages for divers created by the use of a scuba system, scuba systems also have certain disadvantages. For example, the use of a scuba system requires special training in order for the diver to become competent in its use, especially if the diver will be underwater for extended periods of time or at depths greater than thirty feet since the diver is susceptible to the bends, a condition wherein nitrogen which becomes dissolved in the diver's tissues or blood and then expands or outgases when pressure is reduced as the diver rises to the surface, or nitrogen narcosis, a condition wherein the high pressure nitrogen absorbed by the diver acts as a narcotic and disorients the diver. In addition, the high pressure air needed for the air tanks (greater than 200 PSI and up to 3,000 PSI) presents an added risk due to the special equipment needed to refill the air tanks and the potential consequences resulting from misuse or damage. Furthermore, the high pressure air necessitates the use of the complicated and often expensive first and second stage regulators to reduce the pressure of the air in the air tank to a breathable level for the diver. The air tanks can also be cumbersome, bulky, and difficult to wear, particularly when the diver is maneuvering around objects in the water. Finally, the air tanks contain a finite amount of air, thereby minimizing the ability of the diver to stay submerged for very long periods of time, even if the diver remains at a shallow depth during the dive, without requiring the diver to refill or exchange the air tanks.

Another familiar device for use in underwater breathing by a diver is the widely used snorkel. Variations of the snorkel may be seen in U.S. Pat. No. 835,950 issued to Iwanami; U.S. Pat. No. 4,583,536 issued to Howell; and U.S. Pat. No. 3,525,335 issued to Freeman. Divers using snorkels do not need air tanks since the diver remains very close to the surface (i.e., within one foot or less) such that an open ended portion of the snorkel is maintained periodically or continuously above the surface of the water by the diver to enable the diver to obtain air. While a snorkel works well for divers staying close to the surface of the water, snorkels are not suitable for divers who wish to be submerged more than one foot below the surface or for divers who do not or cannot maintain the open end of the snorkel above the surface of the water since the open end of the snorkel will become submerged.

A third type of underwater breathing device for allowing a diver to breath underwater comprises a pump situated on the surface of the water which is connected to a submerged diver via an air line or hose. Examples of this type of device may be seen in U.S. Pat. No. 813,413 issued to Iwanami et al.; U.S. Pat. No. 3,467,091 issued to Aragoma; and U.S. Pat. No. 4,674,493 issued to Mitchell. Devices of this type are particularly useful for diving for extended periods of time since they do not require air tanks containing a finite supply of air. Unfortunately, devices utilizing this principle require a constant flow compressor to avoid air being delivered to the diver in pulses, which can be extremely uncomfortable for the diver and which delivers the air to the second stage type regulator worn by the diver at a high pressure. For this reason, a heavy duty electric or gas-powered pump is typically used to deliver high pressure air to the diver via an air line and a second stage type regulator worn by the diver in this type of system. In a similar fashion to the scuba system described above, therefore, an expensive and/or complicated regulator may be required to reduce the air pressure supplied by the pump or compressor to a level breathable by the diver.

A fourth underwater breathing device comprises a manual hand or foot pump which supplies air under pressure to a reservoir bag for further delivery to a diver through an air hose. An example of this type of underwater breathing device may be seen in U.S. Pat. No. 5,193,530 issued to Gamow et al. In order to maintain the air pressure in the reservoir bag within a preselected range, which is determined by the depth of the diver, a pressure gauge is provided for the pump operator, who then pumps periodically to maintain the proper air pressure in the reservoir bag. Unfortunately, the disclosed system requires constant monitoring of the pressure gauge by the operator and a pumping rate of up to seventeen pumps per minute by the operator to maintain a suitable air pressure in the reservoir bag. Since the diver is not wearing a regulator, the diver cannot control the air flow from the reservoir bag and air is constantly supplied to the diver from the reservoir bag, thereby causing a large portion of the air delivered to the diver to be lost through the one-way exhaust valve located on the diver's mouthpiece.

In addition to underwater breathing devices discussed above, a number of devices used for breathing in irrespirable environments are known in the art. For example, the apparatus disclosed by Great Britain Patent No. 19,080 consists of a manual pump, a breathing bag, and a helmet or mask all connected by flexible tube. Air is delivered to the breathing bag by the manual pump and is then forced to the helmet or mask for respiration by the individual wearing the helmet. Although the pressure at which air is forced to the mask is not disclosed, it is unlikely that it is much above ambient pressure. Great Britain Patent No. 436,546, discloses an apparatus and method for producing breathable air to individuals at high altitudes, especially for use in an airplane. The air supply is compressed to a pressure corresponding to air at ground level and may be supplied to an intermediate rigid container or reservoir in which air may be stored at an elevated pressure. The air is then supplied to an individual wearing a helmet via a flexible tube or to a chamber in which the individual resides. The pressure at which the air is delivered to the helmet or chamber is kept substantially the same (i.e., ground level pressure) at all altitudes. Neither of the Great Britain patents addresses the unique problems involved in supplying air to underwater divers.

Therefore, despite the well developed state of the art in underwater breathing devices, there remains a need for an underwater breathing device that: supplies the air at a low pressure to the regulator worn by the diver, provides air to the diver only when demanded by the diver, is suitable for shallow depth diving while not requiring the diver to maintain a open end of a snorkel or air tube above the surface of the water, does not require the diver to carry a finite supply of air, does not require an expensive or complicated first stage or second stage regulator, and is lightweight, compact, inexpensive, and easily portable.

SUMMARY OF THE INVENTION

It is a general object of the present invention to provide an apparatus for allowing a diver to breath underwater.

It is a specific object of the present invention to provide an apparatus for allowing a diver to breath underwater that is lightweight, compact, easily portable, and easy to use.

It is another general object of the present invention to provide an apparatus for allowing a diver to breath underwater that does not require air to be maintained or supplied at a high pressure.

It is still another general object of the present invention to provide an apparatus for allowing a diver to breath underwater that does supply air to the regulator worn by the diver at a low pressure and a high volume.

It is a specific object of the present invention to provide an apparatus for allowing a diver to breath underwater and for supplying air to the diver only when demanded by the diver.

It is another general object of the present invention to provide an apparatus for allowing a diver to breath underwater at shallow depths for extended periods of time while not requiring the diver to carry a finite supply of air.

It is another specific object of the present invention to provide an apparatus for allowing a diver to breath underwater that supplies a large volume of air to the diver.

Additional objects, advantages, and novel features of the invention shall be set forth in part in the description that follows, and in part will become apparent to those skilled in the art upon examination of the following or may be learned by the practice of the invention. The objects and the advantages may be realized and attained by means of the instrumentalities and in combinations particularly pointed out in the appended claims.

To achieve the foregoing and other objects and in accordance with the purposes of the present invention, as embodied and broadly described herein, an underwater breathing device is provided which includes a pump for supplying air at high volume and low pressure via a flexible, non-collapsible, and expandable air line or hose to a regulator worn by a diver. The air pressure in the system is maintained within a selected range and excess pressure in the air line is eliminated by a one-way pressure relief valve positioned between the pump and the air line. Air delivery to the diver is controlled by a diaphragm wall and a tilt valve located in the regulator worn by the diver. Upon inhalation by the diver, the internal pressure acting outwardly against the diaphragm wall inside the regulator is decreased relative to the external water pressure acting inwardly against the diaphragm wall and the diaphragm wall moves inward and places pressure on the valve stem which then deviates (tilts) from its normal neutral (closed) position to an open position. The change in angle of the stem of the valve stem from the closed position to the open position elevates a valve head of the tilt valve asymmetrically off of a valve seat and allows free passage of compressed air into the regulator from the air line. As the internal pressure acting outwardly against the diaphragm wall increases during exhalation by the diver relative to external water pressure acting inwardly against the diaphragm wall, the diaphragm wall will move outward toward its original position. When the diaphragm wall returns to its original position, the pressure (force) on the valve stem is eliminated and a spring mechanism acting against the valve head returns the valve stem and the valve head to their closed position, thereby stopping the free passage of compressed air into the regulator from the air line. The expandable, non-collapsible, and flexible air line expands when the diver is not inhaling and contracts when the diver is inhaling, thereby functioning as an air reservoir and alternatively increasing and decreasing the amount of air stored within the air line. The regulator also includes a one-way valve to allow the diver to exhale while preventing air from being forced back through the tilt valve and into the air line when the diver exhales.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention.

In the Drawings.

DETAILED DESCRIPTION OF THE PREFERRED EMBODIMENTS

Figure 1:
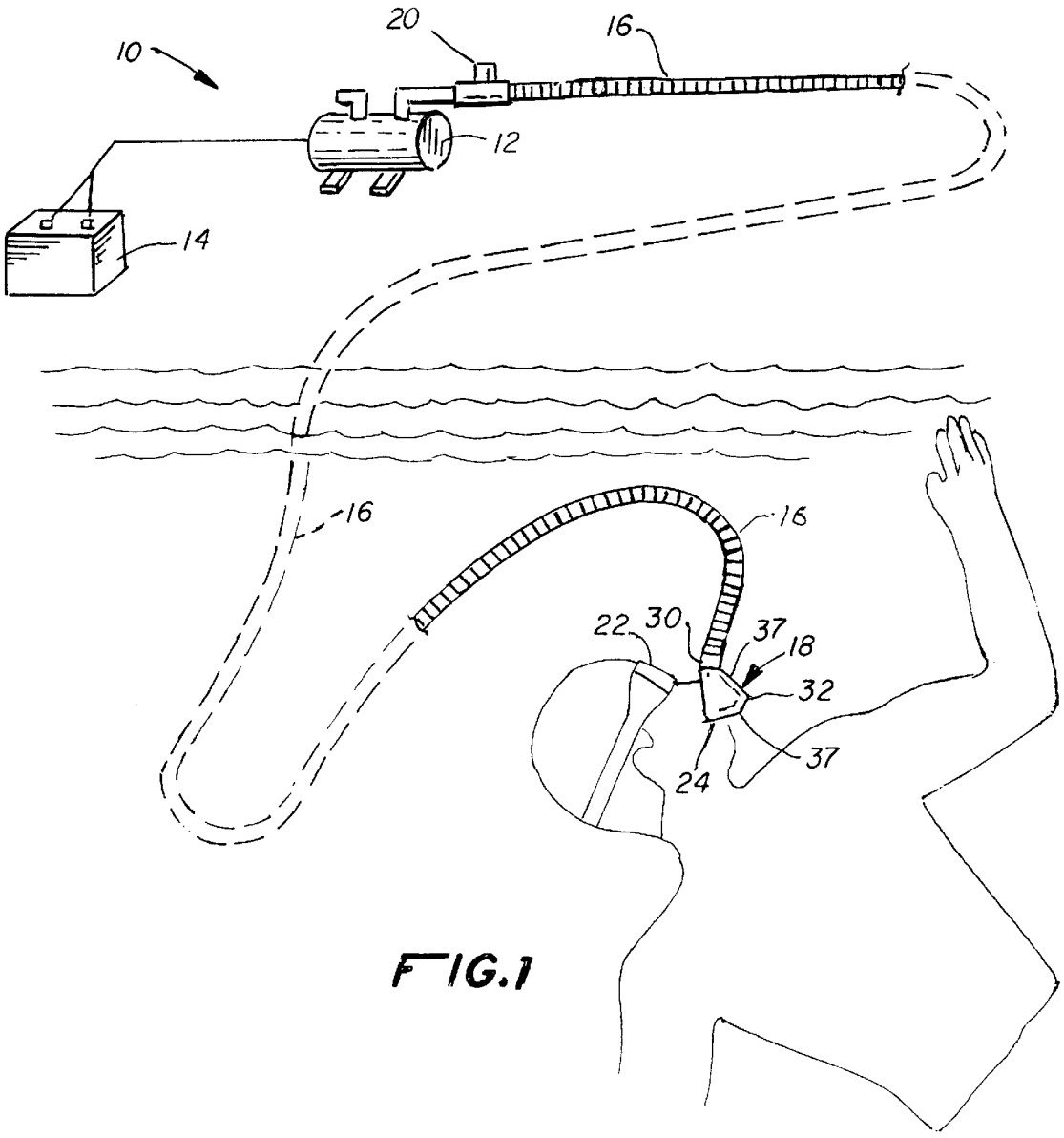
FIG. 1 is an isometric view of the underwater breathing apparatus of the present invention, showing the battery, air pump, pressure relief valve, air hose, regulator, and the diver using the underwater breathing apparatus.

The underwater breathing apparatus 10 of the present invention for supplying a diver D with air at high volume and low pressure is illustrated in FIG. 1 and includes an air pump or compressor 12 supplied with power by a battery 14 (which can be a car or boat battery). The battery 14 can be a conventional and well known twelve volt battery, a gel battery, an AC (alternating current) 110 volt power source, or other analogous power sources. The pump 12 forces air into the flexible, expandable, non-collapsible, and hollow air hose or line 16 which is connected to the generally hollow regulator 18 worn by the diver D. The air line 16 preferably has a length of 30 feet or more. In order to control the maximum air pressure in the air line 16 and the regulator 18 and the amount of air contained within the air line 16, a pressure relief valve 20 is placed between the pump 12 and the air line 16. The pressure relief valve 20 operates to release air from the air line 16 when the air pressure in the air line 16 is at or above a predetermined maximum pressure level such as, for example, ten to twenty pounds-per-square inch (PSI), to prevent the pump 12 from over pressurizing the air line 16 or the regulator 18. The air line 16 and the regulator 18 act as a pressurized snorkel for the diver D. That is, with the underwater breathing apparatus 10, the diver D is able to easily maintain an end of the air line 16 above the water surface so that the diver D is supplied with air and the air line 16 remains continuously filled with pressurized air supplied by the air pump or air compressor 12. In addition, the underwater breathing apparatus 10 does not require the diver D to wear a bulky or cumbersome backpack or chest assembly in order to breath, thereby improving the diver's ability to maneuver in the water.

The air pressure in the air line 16 is preferably maintained by the pump 12 and the pressure relief valve 20 within a desired range based on the depth to which the diver D will descend. Furthermore, the air pressure in the air line 16 must be maintained at a high enough level to force a positive flow of air to the diver D at the desired depth of the diver D. For most applications, the desired diving depth will of the diver D will range from two to twelve feet, with the corresponding minimum air pressure range in the air line 16 being approximately one to six PSI gauge (all pressures cited herein are gauge pressures, which means the pressure difference between the regulated pressure and the ambient pressure). The minimum air pressure in the air line 16 required for a positive air flow for a selected depth of a diver's descent may be calculated from a well known linear relationship of water depth to pressure. For example, a diving depth of four feet will require approximately 1.72 PSI of air pressure in the air line 16, while a diving depth of eight feet will require approximately 3.44 PSI, and so on. It should be noted that for practical purposes, and within the preferred depth range of the underwater breathing apparatus 10, the pressure can be rounded off to the nearest 0.1 PSI.

The air line 16 allows the delivery of pressurized air (at low pressure) to the regulator 18 and to the diver D. For best results, the diver D preferably wears the regulator 18 and a conventional face mask 22 although the regulator 18 can be connected to the face mask 22. The air line 16 connecting the pump 12 to the regulator 18 is preferably flexible so as to not restrict the diver's movements and is also preferably non-collapsible to prevent inadvertent disruption of the air flow to the diver D. If the length of the air line 16 is too short, for example 5 feet or less, the air line 16 may not function adequately as a reservoir of air. Therefore, the air line 16 preferably has a length greater than 20 feet. Furthermore, the air line 16 preferably has a diameter greater than ½ inch and less than 2 inches. The flexibility and length (preferably greater than 20 feet) of the air line 16 also allows the air line 16 to expand and contract during exhalation and inhalation, respectively, by the diver D, thereby causing the air line 16 to act as a reservoir of low pressure air that will vary the amount of air contained within the airline 16, as will be discussed in more detail below.

Figure 2:
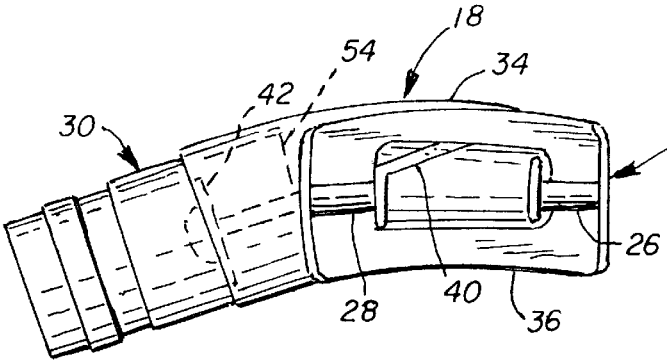
FIG. 2 is a front elevational view of the regulator of FIG. 1, showing the first embodiment of the tilt valve in the closed position.
Figure 3:
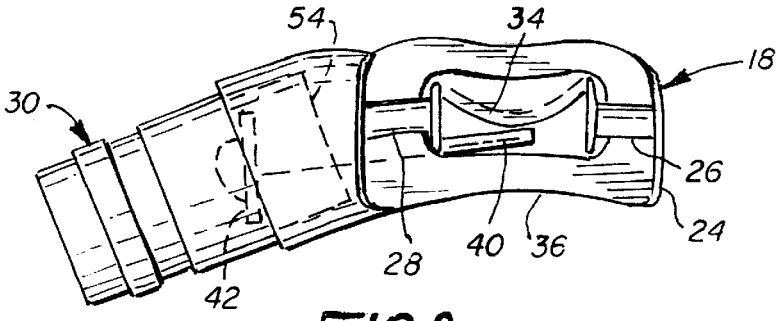
FIG. 3 is a front elevational view of the regulator of FIG. 1, showing the first embodiment of the tilt valve in the open position.
Figure 4:
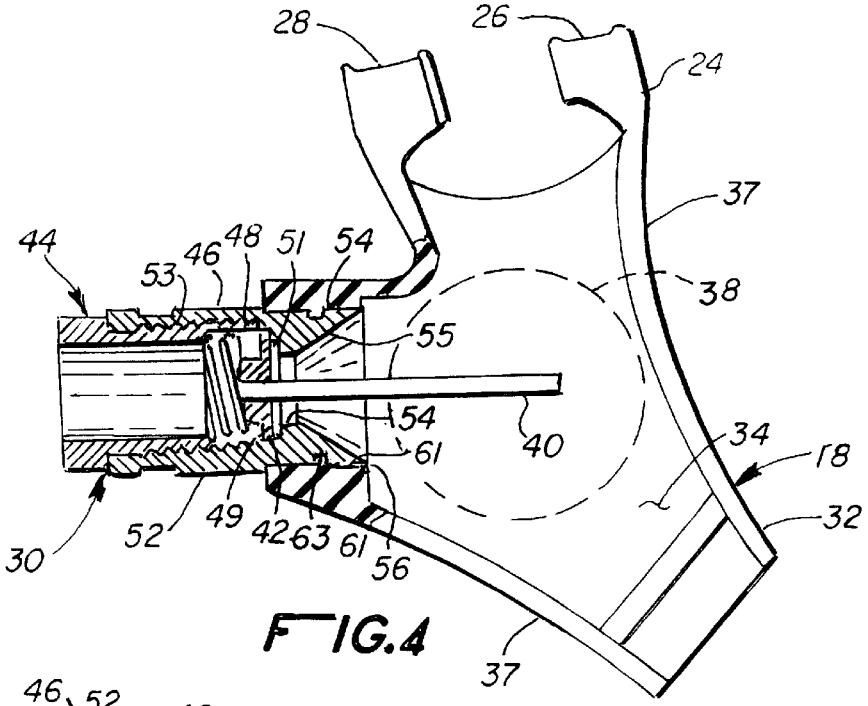
FIG. 4 is a cross-sectional view of the regulator of FIG. 1 looking towards the diaphragm wall of the regulator and showing the first embodiment of the tilt valve in the closed position.

Referring to FIGS. 2–4, the regulator 18 will now be discussed in more detail. The regulator 18 includes a conventional and preferably flexible mouthpiece 24 having tooth grips 26, 28 to enable the diver D to bite or hold the flexible or pliable tooth grips 26, 28 securely with the diver's teeth and to hold the mouthpiece 24 securely in the diver's mouth. The diver's mouth preferably forms a watertight and airtight seal around the mouthpiece 24. The regulator 18 also includes the tilt valve 30 for connecting the regulator 18 to the air line 16 and for allowing the passage of air from the air line 16 to the diver D during inhalation. In addition, the regulator 18 includes the one-way valve 32 to allow air to be exhaled by the diver D and exhausted from the regulator 18. The low pressure regulator 18 is preferably constructed of a flexible material of low durometer hardness, such as silicone or polyurethane. The durometer hardness of the material comprising the regulator 18 is preferably less than or equal to seventy. It is also possible, however, for the regulator 18 to be constructed of other materials such as, for example, rubber or plastic.

A significant built-in safety feature of the underwater breathing apparatus 10 of the present invention is that the air line 16 and the regulator 18 will generally operate to prevent the diver D from going below a depth of approximately forty feet since the air pressure of the air in the air line 16 and the regulator 18 will be at approximately twenty PSI at that depth. At depths greater than approximately twenty feet, the tilt valve 30 will not allow air to flow from the air line 16 into the regulator 18, thereby signaling the diver that he or she has gone below a depth of forty feet.

Another significant feature and advantage of the underwater breathing apparatus 10 of the present invention is the tilt valve 30 and the operation of the tilt valve 30 in conjunction with the diaphragm wall 34 of the regulator 18. As will be discussed in more detail below, the tilt valve 30 acts to open and close the passage of air from the air line 16 to the regulator 18 during inhalation and exhalation, respectively, of the diver D. Since the tilt valve 30 is periodically closed, air is not continuously supplied to the diver D. The diver D controls the operation of the tilt valve 30, however, during the normal inhalation and exhalation of the diver D. Thus, air from the air line 16 is supplied to the diver D only upon demand by the diver D, but air is not supplied to or forced on the diver D from the air line 16 when the diver D does not want the air. In addition, the tilt valve 30 and the diaphragm wall 34 allow air to be delivered to the regulator 18 and the diver D at low pressure and high volume. The air is supplied to the regulator 18 and the diver D at low pressure since the pressure relief valve 20 maintains a maximum pressure in the air line 16 that is less than or equal to twenty PSI. The air is supplied to the regulator 18 and the diver D at a high volume due to the airline 16 functioning as a reservoir of low pressure air, as will be discussed in more detail below.

The regulator 18 includes the bottom wall 36, the side walls 37, and the diaphragm wall 34. While the bottom wall 36 preferably has a thickness of, for example, one-sixteenth of an inch or two millimeters, the diaphragm wall 34 is thinner than the bottom wall 36 and the side walls 37 and preferably has a thickness of, for example, one-thirtysecond of an inch or one millimeter. It is preferable that the thickness of the regulator 18 at places other than the diaphragm wall 34 be at least twice as thick as the diaphragm wall 34. The thickness of the bottom wall 36 and the side walls 37 is sufficiently large such that they are not significantly displaced during inhalation or exhalation by the diver D. The thickness of the diaphragm wall 34, on the other hand, is sufficiently thin, particularly in the circular core 38 of the diaphragm wall 34, such that the diaphragm wall 34, particularly the circular core 38 of the diaphragm wall 34, is significantly displaced during inhalation of the diver D. It is the difference in the thickness between the diaphragm wall 34 and the bottom 36 and side walls 37 that cause the diaphragm wall 34 to have a greater relative flexibility. The circular core 38 can have an outwardly concave shape and can be displaced as much as one and one-half inches during inhalation by the diver D. The diameter of the circular core 38 of the diaphragm wall 34 is preferably between one-half and three inches.

Figure 6:
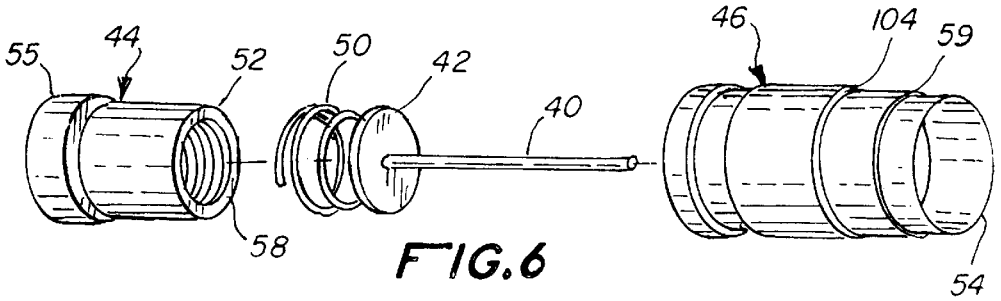
FIG. 6 is an isometric view of the disassembled major components the first embodiment of the tilt valve of the regulator of FIG. 1.
Figure 5:
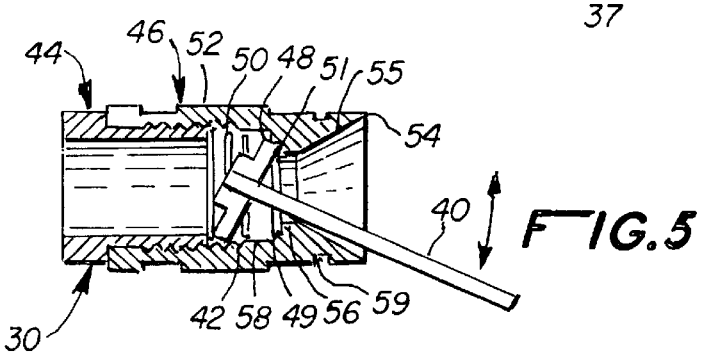
FIG. 5 is a cross-sectional view of the first embodiment of the tilt valve of FIG. 4, showing the first embodiment of the tilt valve in the open position.

Now referring to FIGS. 4–6, the tilt valve 30 includes the valve stem 40 which is rigidly connected to the valve head 42. The tilt valve 30 is created by connecting the externally threaded hollow insert 44 to the internally threaded hollow insert cap 46 to create a unitary valve body wherein the valve head 42 is adjacent to the valve seat formed by the annular surface 48 and the o-ring 51 and compresses the bias device or spring 50 against the annular insert surface 52. The valve stem 40 extends from the valve head 42 and out of the hollow end 54 of the hollow insert cap 46. The hollow end 54 of the hollow insert cap 46 is at the downstream end or port of the tilt valve 30 while the hollow end 57 of the hollow insert 44 is at the upstream end or port of the tilt valve 30. Instead of using an o-ring 51, it is also possible to use a gasket, to coat the annular surface 48 with silicone or rubber spray, or to use other suitable materials to create an air tight seal for the valve head 42. When the tilt valve 30 is operating in the closed position, the spring 50 biases the valve head 42 such that the o-ring 51 is compressed between the valve head 42 and the annular surface 49, thereby forming an airtight seal between the valve head 42 and the annular surfaces 48, 49 (or, in other words, between the valve head 42 and the valve seat defined by the annular surface 48 along with the o-ring 51).

The spring 50 is located upstream of the valve head 42, the annular surface 48, and the o-ring 51, and downstream of the annular surface 52 relative to the air line 16. As best seen in FIGS. 4 and 5, the hollow cap 46 has an inner diameter that decreases when moving from the end 54 toward the edge 55 of the bore 56 to allow the valve stem 40 and the valve head 42 to become rotationally displaced while preventing the valve head 42 or the spring 50 from being removable from the tilt valve 30 unless externally threaded insert 44 is removed from the internally threaded cap 46. The inner diameter of the bore 58 created between the annular surface 48 and the annular surface 52 is preferably and approximately larger than, but not less than or equal to, the diameter of the valve head 42 such that the valve head 42 can be displaced enough during displacement of the valve stem 40 by the diaphragm wall 34 to create a gap between the valve head 42 and the o-ring 51 and annular surface 48 to allow air to flow from the air line 16 to the regulator 18. The inner diameter of the bore 58 is preferably not so large, however, that the valve head 42 cannot be displaced substantially without causing a simultaneous tilt or displacement of the valve stem 40.

The hollow insert cap 46 includes a circular groove 59. When the end 54 of the tilt valve 30 is inserted into the circular bore 61 in the regulator 18, the inwardly projecting circular lip 63 in the bore 61 is positioned within the groove 59 to securely fasten the tilt valve 30 to the regulator 18. For sake of simplicity and explanation, the hollow insert cap 46 is shown having only a single circular groove 59. It is possible and generally preferable, however, for the hollow insert cap 46 to include a plurality of circular grooves parallel to the circular groove 59 and for the circular bore to include a corresponding plurality of circular lips parallel to the circular lip 63 to create an even more secure attachment of the insert cap 46 and the regulator 18. An example of a plurality of grooves 65 is shown in the second embodiment of the tilt valve in FIGS. 7–9. The tilt valve 30 can also be attached to the regulator 18 by bonding, gluing, or other suitable means.

During exhalation by the diver D or during periods when the diver D is neither inhaling nor exhaling, the diaphragm wall 34 is located in its normal position, as shown in FIGS. 2 and 4, and the spring 50 acts as a bias against the valve head 42 to keep the valve head 42 in its closed position. When the valve head 42 is in its closed position, the valve head 42 is pressed against the annular surface 48 and the o-ring 51 by the spring 50 so as to form an airtight seal between the valve head 42 and the annular surfaces 48, 49, thereby preventing air from flowing from the air line 16 to the regulator 18. Upon inhalation by the diver D, the pressure acting outwardly against the diaphragm wall 34 is decreased below the external water pressure acting inwardly against the diaphragm wall 34 and the diaphragm wall 34 is displaced inward toward the bottom wall 36 of the regulator 18, as shown in FIG. 3. During inhalation by the diver D, the diaphragm wall 34 contacts the valve stem 40 of the tilt valve 30 and the lateral force of the diaphragm wall 34 acting against the valve stem 40 deflects and rotates the valve stem 40 from its closed position into its open position. The tilt valve 30 and the valve stem 40 are preferably positioned such that valve stem 40 contacts the center of circular core 38 of the diaphragm wall 34 particularly during inhalation. Displacement of the valve stem 40 by the diaphragm wall 34 during inhalation by the diver D simultaneously moves the valve head 42 off of the valve seat formed by the annular surfaces 48, 49 and the o-ring 51 such that the valve head 42 is not uniformly compressing the o-ring 51 between the valve head 42 and the annular surface 49 and such that an airtight seal is no longer formed between the valve head 42 and the annular surfaces 48, 49 (i.e., a gap is created between the valve head 42 and the annular surfaces 48, 49), thereby allowing pressurized air from the air line 16 to flow into the hollow regulator 18 and to the diver D.

During inhalation by the diver D, the air pressure in the diver's lungs and the regulator 18 will initially decrease causing the diaphragm wall 34 to move inwardly, thereby causing the tilt valve 30 to open. The air pressure in the diver's lungs and in the regulator 18 will then increase due to the increase of air flowing to the diver's lungs and the regulator 18, thereby causing the outward air pressure applied against the diaphragm wall 34 to increase. At the end of inhalation, while the valve stem 40 and the valve head 42 are still in their open positions, the pressure acting outwardly against the diaphragm wall 34 from the air in the regulator 18 and the spring biased valve stem 40 pressing outwardly against the diaphragm wall 34 will increase until eventually the pressure acting outwardly against the diaphragm wall 34 becomes equal to or greater than the water pressure acting inwardly against the diaphragm wall 34, thereby causing the diaphragm wall 34 to return to its original closed position shown in FIG. 2. When the diaphragm wall 34 returns to its original position, the force applied to the valve stem 40 and the spring 50 by the diaphragm wall 34 is eliminated or otherwise reduced to the point such that the bias of the compressed spring 50 on the valve head 42 causes the valve head 42 to return back to its closed position on the valve seat formed by the annular surface 48 and the o-ring 51, thereby compressing the o-ring 51 between the valve head 42 and the annular surfaces 48, 49, forming an airtight seal between the valve head 42 and the annular surface 48, and closing off the passage of air from the air line 16 to the regulator 18. The intermittent flow of air from the air line 16 to the regulator 18 occurs such that the diver D only receives the amount of air demanded by the diver D for each breath at that depth. Furthermore, by delivering air to the diver D only when demanded by the diver D during inhalation, no air is wasted and the diver D can control the flow of air from the air line 16.

The structure of the tilt valve 30 also prevents air from the diver's lungs and the regulator 18 from flowing through the tilt valve 30 to the air line 16 when the diver D exhales. More specifically, when the diver D exhales, the air pressure of the air inside the air line 16 is at a higher pressure than the air pressure of the air exhaled by the diver D which keeps the valve head 42 and the valve stem 40 from tilting into their open positions. During exhalation, therefore, the valve head 42 remains in the closed position, thereby preventing air from flowing through the tilt valve 30 to the air line 16.

The diver D can also, of course, exhale through his or her nose if desired or if the regulator 18 does not include the optional but preferable one-way valve 32. One-way valves such as the type used for the one-way valve 32 in the underwater breathing apparatus 10 of the present invention are well known to people having ordinary skill in the art and need not be described in any further detail for purposes of describing the present invention.

Figure 7:
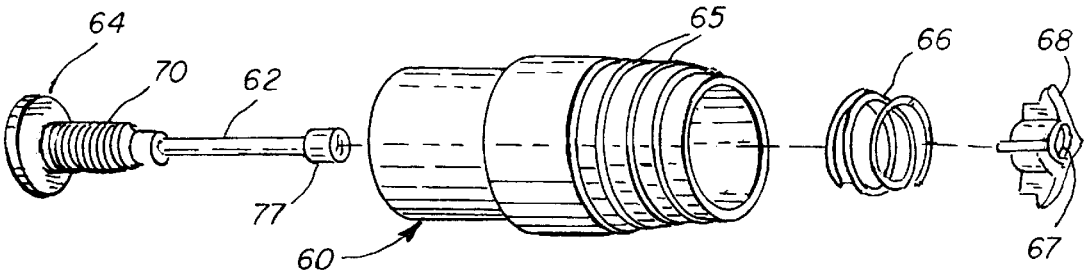
FIG. 7 is an isometric view of the disassembled major components the second embodiment of the tilt valve of the regulator of FIG. 1.
Figure 9:
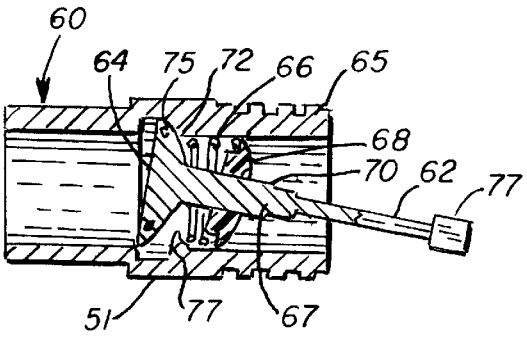
FIG. 9 is a cross-sectional view of the second embodiment of the tilt valve of FIG. 8, showing the second embodiment of the tilt valve in the open position.
Figure 8:
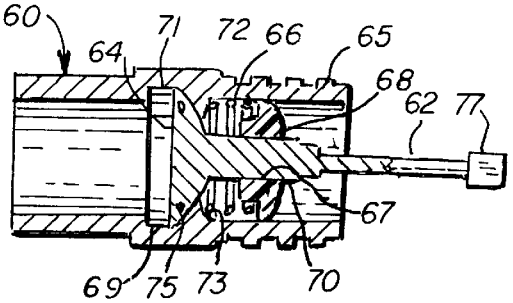
FIG. 8 is a cross-sectional view of the second embodiment of the tilt valve of the regulator of FIG. 1, showing the second embodiment of the tilt valve in the closed position.

A second embodiment of the tilt valve 30 is shown in FIGS. 7–9. In contrast to the first embodiment of the tilt valve 30 shown in FIGS. 4 and 6 which uses the externally threaded insert 46 and the internally threaded insert 46 to create a unitary valve body, the second embodiment of the tilt valve 30 includes a hollow valve body 60 comprising a single piece of material. While the valve stem 62 and the valve head 64 are rigidly connected, as in the first embodiment of the tilt valve 30, the spring 66 is located downstream of the valve head 64 relative to the air line 16, instead of upstream of the valve head 64 relative to the air line 16. When assembling the second embodiment of the tilt valve 30, the valve stem 62 is inserted through the valve body 60, the spring 66, and the internally threaded central bore 67 of the tightening nut 68. The threaded central bore 67 of the tightening nut 68 is connected to the external threads 70 located on the base of the valve stem 62 such that the spring 66 is compressed between the tightening nut 68 and the annular surface 73. In addition, the valve head 64 is located within the bore 71 formed by the sloped wall 72 and the wall 69.

When the second embodiment of the tilt valve 30 has been assembled, as best seen in FIG. 8, the valve stem 62 and the valve head 64 are in their normal closed positions and the tightening nut 68 compresses the spring 66 against annular surface 73 such that the valve head 64 forms an air tight seal with the sloped surface 72. The second embodiment of the tilt valve 30 can also have an o-ring 75 similar to the o-ring 51 discussed above in relation to FIGS. 4–5 positioned so that the o-ring 75 is compressed between the valve head 64 and the sloped surface 72, thereby improving the air tight seal between the valve head 64 and the sloped surface 72. During operation of the underwater breathing apparatus 10, the second embodiment of the tilt valve 30 works in a manner similar to the first embodiment of the tilt valve 30 discussed above. That is, when the diver D inhales, the diaphragm wall 34 is forced or compressed inward toward the bottom wall 36 of the regulator 18 such that the valve stem 62 is displaced from its normal and original closed position (shown in FIG. 8) to its open positions (shown in FIG. 9), thereby causing the valve head 64 to be displaced from its normally closed position (shown in FIG. 8) to its open position (shown in FIG. 9). When the valve head 64 is displaced from its closed position to its open position, the airtight seal between the valve head 64 and the sloped surface 72 is broken and air will flow from the air line 16 into the regulator 18 and the diver D. Air from the air line 16 will flow into the regulator 18 when the valve stem 62 and the valve head 64 are displaced and are in their open position, but not when the valve stem 62 and the valve head 64 are in their normal and original closed positions. The valve stem 62 may also may also include the head portion 77 to facilitate contact by the valve stem 62 with the diaphragm wall 34.

Figure 10:
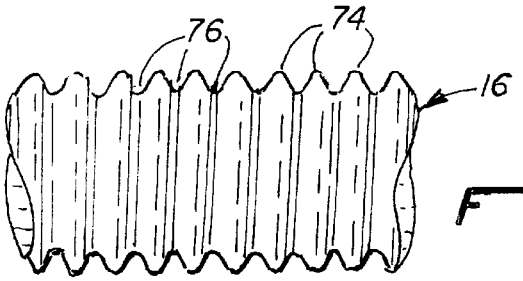
FIG. 10 is an isometric view of a segment of the air hose of FIG. 1, showing the segment of the air hose in an unexpanded position.
Figure 11:
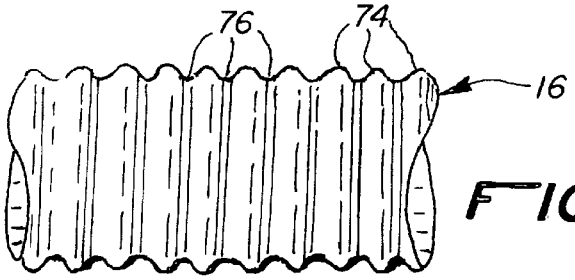
FIG. 11 is an isometric view of the segment of the air hose of FIG. 11, showing the segment of the air hose in an expanded position.

Another significant feature and advantage of the underwater breathing apparatus 10 of the present invention is the expandable, flexible, non-collapsible, and hollow air line or hose 16. Now referring to FIGS. 10 and 11, the air line 16 has a hollow and corrugated shape comprising an alternating series of ridges 74 and depressions 76. As previously discussed above, the air line 16 is preferably non-collapsible so as to prevent inadvertent disruption of the air flow to the diver D. In addition, the air line 16 is preferably flexible so that it does not restrict the movement of the diver D in the water. Most importantly, the corrugated structure of the air line 16 also allows the air line 16 to expand and contract during exhalation and inhalation, respectively, of the diver D such that the air line 16 acts as a reservoir of air for the diver D. More specifically, the corrugated structure of the air line 16 allows the air line 16 to expand both radially and axially (longitudinally) from its normal position, as shown in FIG. 10, to its expanded position, as shown in FIG. 11 when air is pumped into the air line 16 by the pump 12. When the air line 16 is expanded, it prefereably elongates and increases its diameter between diametrically opposite portions of the air line 16. That is, when the air line 16 is in its expanded position, the vertical distance (relative to FIGS. 10 and 11) between the outermost radial part of the ridge 74 and the innermost part of the depression 76 is less than when the air line 16 is in its normal and unexpanded position, thereby increasing the volume inside the hollow air line 16 and increasing the amount of air 16 stored within the air line 16. In addition, when the air line 16 is in its expanded position, the length of the air line segment shown in FIG. 10 enlarges (elongating the air line 16) to further increase the volume of air line 16 and the amount of air the air line 16 can contain.

When the diver D is exhaling, or at least not inhaling, the pump 12 forces air into the air line 16 but air is not flowing into the regulator 18, thereby expanding the air line 16 and increasing the amount of air contained within the air line 16. If the pressure within the air line 16 becomes too large, the pressure relief valve 20 will releases the excess air pressure in the air line 16 and the amount of air contained within the air line 16 generally stopped from continuing to build. When the diver D inhales, the air stored within the air line 16 flows into the regulator 18, thereby reducing the amount of air stored within the air line 16, reducing the air pressure within the airline 16, and causing the air line 16 to return to its unexpanded position. As soon as the diver D stops inhaling, the amount of air stored within the air line 16 and the air pressure within the air line 16 once again begins to increase, the air line 16 begins to expand, and the process is repeated. The use of the air line 16 as an expandable reservoir of air eliminates the need for a potentially cumbersome reservoir bag or other storage space for the air while ensuring that the diver D will have a supply of air from which to draw his or her next breath when demanded by the diver D. Another benefit of the expandable air line 16 is that the air from the air line 16 will be supplied to the regulator 18 and the diver D at high volume. That is, the air line 16 will hold an large enough amount of air at low pressure such that at any given moment, the diver D will have ample air supplied to him or air from the air line 16 and such that the molecules of air in are not significantly compressed while in the air line 16.

Figure 12:
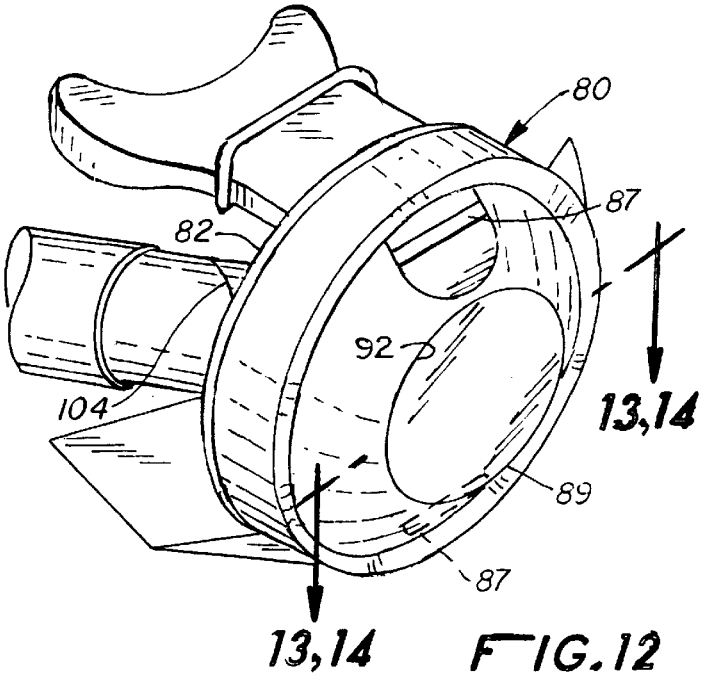
FIG. 12 is an isometric view of a conventional second stage diving regulator that has been modified to function as a low pressure regulator.

While the underwater breathing apparatus 10 described above has used a specially designed regulator 18, it is also possible to modify an existing scuba regulator to work with the tilt valve 30 described above. U.S. Pat. No. 3,570,808 issued to Wren discloses such a conventional scuba diving regulator. Now referring to FIGS. 12–14, a conventional scuba regulator 80 is shown for connection to air tanks (not shown) via an air line or hose (not shown). The regulator 80 includes an opening 82 in the regulator wall 83 where a high pressure second stage regulator valve is typically inserted. A low pressure tilt valve 30 is inserted into the opening 82 such that the valve stem 40 is positioned against the movable central portion 84 of the diaphragm 86 and the open end 54 of the valve 30 is positioned within the hollow interior of the regulator 80.

The slots 87 allow water to flow into the hollow portions 93 of the regulator 80, thereby placing inwardly directed pressure on the diaphragm 86. Air within the hollow portion 95 places an outwardly directed pressure or force against the diaphragm 86. The operation of the diaphragm 86 is similar to the operation of the diaphragm wall 34 discussed above. That is, when the diver D inhales, the pressure applied outward against the central portion 84 of diaphragm 86 by the air and the valve stem 40 is less than the pressure applied inward by the water against the diaphragm 86, thereby causing the diaphragm 86 to move from its normally closed position (shown in FIG. 13) to its open position (shown in FIG. 14).

When the diaphragm 86 is moved from its normally closed position to its open position, the central portion 84 of the diaphragm 86 contacts the valve stem 40, displaces the valve stem 40 (shown in FIG. 14) and the valve head (not shown in FIGS. 12–14) from their normally closed positions to their open positions (as discussed above in relation to FIGS. 2–4), and allows air to flow from the air line 16 into the hollow portion 95 of the regulator 80. When the diver D stops inhaling, air from the air line 16 continues to flow into the regulator until the pressure acting outwardly against the central portion 84 of the diaphragm 86 becomes equal to or greater than the water pressure acting inwardly against the diaphragm, thereby causing the central portion 84 of the diaphragm 86 and the diaphragm 86 to return to their normally closed positions and stopping the flow of air from the air line 6 into the regulator 80.

Figure 13:
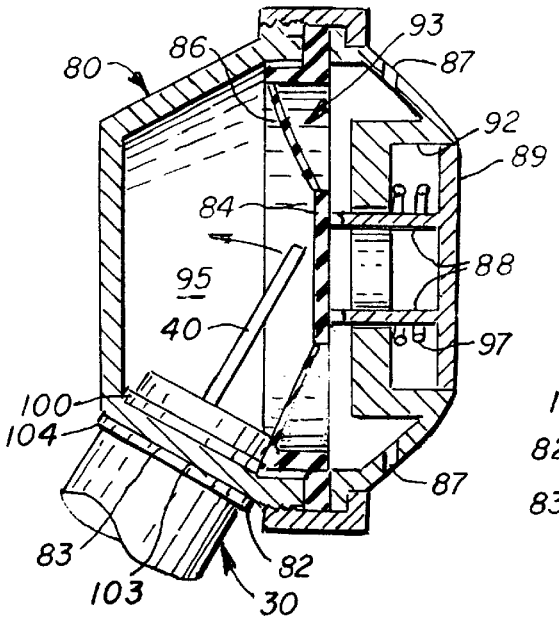
FIG. 13 is a cross-sectional view of the conventional second stage diving regulator of FIG. 12, taken along the line 13—13 in FIG. 12, showing the diaphragm and the tilt valve in the closed position.
Figure 14:
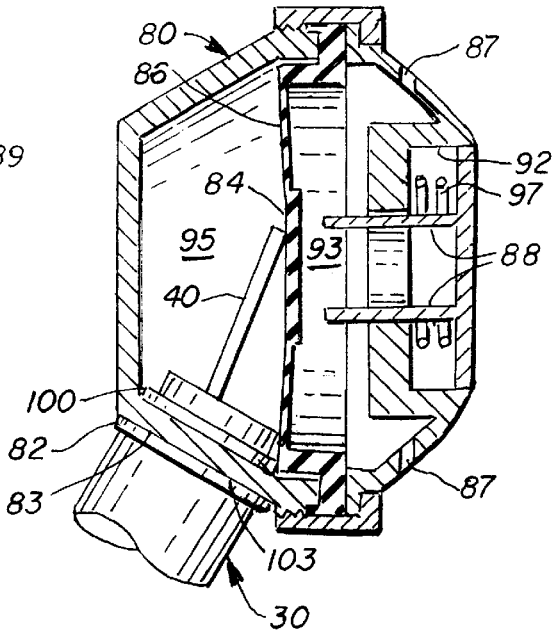
FIG. 14 is a cross-sectional view of the conventional second stage diving regulator of FIG. 12, taken along the line 14—14 in FIG. 12, showing the diaphragm wall and the tilt valve in the open position.

As best seen in FIGS. 13 and 14, the groove 59 (not shown in FIGS. 13 and 14 but shown in FIGS. 4–6) of the valve 30 is filled by the band 100 which, in a similar fashion to the lip 63 discussed above in relation to FIG. 4, holds the valve 30 securely in the regulator 80. In addition, the o-ring 102 preferably located parallel to the band 100 but outside the regulator 80 is compressed by the outer surface 103 of the regulator 80 and the lip surface 104 of the valve 30, thereby forming a tight seal between the valve 30 and the regulator 80.

The conventional purge button 89 is attached to the rods 88 and slides within the bore 92 when pressed by the diver D. The rods 88 are not connected to the central portion 84 of the diaphragm 86, and the spring 97 located within the bore 92 acts as a bias against the purge button 89 to keep the purge button 89 from sliding within the bore 92 during normal inhalation or exhalation by the diver D. Only when the diver D actually presses the purge button 89 will the purge button 89 move within the bore 92 and displace the diaphragm 86 and the valve stem 40. Purge buttons such as the type used for the purge button 89 in the underwater breathing apparatus 10 of the present invention are well known to people having ordinary skill in the art and need not be described in any further detail for purposes of describing the present invention.

The foregoing description is considered as illustrative only of the principles of the invention. Furthermore, since numerous modifications and changes will readily occur to those skilled in the art, it is not desired to limit the invention to the exact construction and process shown and described above. Accordingly, all suitable modifications and equivalents may be resorted to falling within the scope of the invention as defined by the claims which follow. For example, the pump 12 can be a manually operated pump that is controlled and operated by a human operator.

The embodiments of the invention in which an exclusive property or privilege is claimed are defined as follows:

1. An apparatus for supplying an inhaling and exhaling diver with air while the diver is underwater at a depth less than a predetermined depth and for reducing the amount of air supplied to the diver when the diver is at depths greater than the predetermined depth comprising:

a pump capable of creating a stream of air;

a hollow air line that is expandable and contractible and that has a first opening and a second opening, said first opening being connected to said air pump such that at least a portion of said stream of air created by said air pump flows into said first opening of said air line, and wherein said air line is corrugated to allow the line to expand and contract radially and longitudinally in response to the exhaling and inhaling of the diver;

a pressure relief valve for preventing air pressure within said air line from exceeding approximately twenty pounds-per-square inch;

a regulator having a hollow interior formed by a bottom wall, side walls, and a diaphragm wall, wherein said side walls include a hollow bore and said diaphragm wall is movable in a first direction when the diver is inhaling and movable in a second direction when the diver is not inhaling; and a hollow valve having an open upstream port and a open downstream port, said upstream port being attached to said second opening of said hollow air line and said downstream port being inserted into said hollow bore of said regulator, said valve including a valve head movable between a closed position and an open position when the diver is at a depth less than the predetermined depth and connectable to said diaphragm wall such that when said diaphragm wall moves in said first direction and the diver is at a depth of less than the predetermined depth, said valve head is movable from its closed position to its open position and when said diaphragm moves in said second direction, said valve head is movable from its open position to its closed position, further wherein said valve head is disposed between said upstream port and said downstream port, such that when said valve head is in its closed position, air cannot flow from said second opening of said air line into said regulator and such that when said valve head is in its open position, air can flow from said second opening of said air line into said regulator.

2. The apparatus of claim 1, wherein said air line is at least twenty feet in length.

3. The apparatus of claim 1, wherein said valve includes a valve stem rigidly connected to said valve head and extending perpendicularly outward from said valve head such that said valve stem contacts said diaphragm wall when said diaphragm wall moves in said first direction.

4. The apparatus of claim 3, wherein said hollow valve includes a biasing means for biasing said valve head into its closed position.

5. The apparatus of claim 4, wherein said biasing means is positioned upstream of said valve head.

6. The apparatus of claim 4, wherein biasing means is positioned downstream of said valve head.

7. The apparatus of claim 4, wherein said biasing means includes a spring.

8. The apparatus of claim 4, wherein said hollow valve includes a valve seat and said biasing means compresses said valve head against said valve seat when said valve head is in its closed position.

9. The apparatus of claim 8, wherein said at least a portion of said valve head is disposed away from said valve seat when said valve head is in its open position.

10. The apparatus of claim 1, wherein said diaphragm wall has a thickness, said side walls have a thickness, and said bottom wall has a thickness, wherein said thickness of said diaphragm wall is less than said thicknesses of said bottom wall and said side walls.

11. The apparatus of claim 1, wherein said regulator comprises a material having a durometer hardness less than or equal to seventy.

12. The apparatus of claim 1, wherein when said hollow regulator has an internal volume and when diaphragm wall moves in said first direction, said internal volume of said regulator is reduced.

13. An apparatus for supplying an inhaling and exhaling diver with air while the diver is underwater at a depth less than the predetermined depth and for reducing the amount of air supplied to the diver when the diver is at depths greater than the predetermined depth, comprising:

a hollow air line that is expandable when said diver is not inhaling and contractible when said diver is inhaling and that has a first opening and a second opening, and wherein said air line is corrugated to allow the line to expand and contract radially and longitudinally in response to the exhaling and inhaling of the diver;

pumping means connected to said first opening of said air line for continuously pumping air into said air line and for maintaining air pressure within said air line at a pressure less than a predetermined maximum pressure of approximately twenty pounds per square inch;

a regulator having a hollow interior formed by a bottom wall, side walls, and a diaphragm, wherein said side walls include a hollow bore and said diaphragm wall is moveable in a first direction when the diver is inhaling and movable in a second direction when the diver is not inhaling; and a hollow valve having an open upstream port and an open downstream port, said upstream port being attached to said second opening of said hollow air line and said downstream port being inserted into said hollow bore of said regulator, said valve including a valve head movable between a closed position and an open position when the diver is at a depth less than the predetermined depth and connectable to said diaphragm wall such that when said diaphragm wall moves in said fist direction and the diver is at a depth less than the predetermined depth, said valve head is movable from its closed position to its open position and when said diaphragm wall moves in said second directions, said valve head is movable from its open position to its closed position, further wherein said valve head is disposed between said upstream port and said downstream port such that when said valve head is in its closed position, air cannot flow from said second opening of said air line into said regulator and such that when said valve head is in its open position, air can flow from said second opening of said air line into said regulator.

14. The apparatus of claim 13, wherein said air line is at least twenty feet in length.

15. The apparatus of claim 13, wherein said air line is greater than five feet in length.

* * * * *